United States Patent [19]

Ryan et al.

[11] 4,190,483

[45] Feb. 26, 1980

[54] BUTT SPLICER

[75] Inventors: Ralph L. Ryan, East Hanover; Charles M. Taitel, Parsippany, both of N.J.

[73] Assignee: Compensating Tension Controls, Inc., West Caldwell, N.J.

[21] Appl. No.: 915,880

[22] Filed: Jun. 15, 1978

Related U.S. Application Data

[63] Continuation of Ser. No. 777,586, Mar. 15, 1977, abandoned.

[51] Int. Cl.[2] ..... B65H 21/00

[52] U.S. Cl. ..... 156/504; 156/505; 242/58.3; 242/58.5

[58] Field of Search ..... 156/504, 505, 157, 159, 156/304, 502, 506, 510; 242/58.1, 58.3, 58.4, 58.5

[56] References Cited

U.S. PATENT DOCUMENTS

| | | | |
|---|---|---|---|
| Re. 29,365 | 8/1977 | Butler, Jr. | 156/504 X |
| 3,565,731 | 2/1971 | Schmermund | 156/504 |
| 3,580,757 | 5/1971 | Niepmann | 156/504 |
| 3,939,032 | 2/1976 | Taitel et al. | 156/505 |
| 3,995,791 | 12/1976 | Schoppee | 156/505 X |
| 4,010,911 | 3/1977 | Heitmann | 156/505 X |

FOREIGN PATENT DOCUMENTS 166368 12/1955 Australia .

*Primary Examiner*—Michael G. Wityshyn
*Attorney, Agent, or Firm*—Gerald Durstewitz

[57] ABSTRACT

A butt splicing unit for cutting a web running from a depleting roll and splicing the end of a supply web to the cut end of the running web. The unit includes a rectangular stationary knife and two moveable knife members below and on each side of the stationary knife. Each of the moveable knives cooperate with one of the knife edges formed by the lower corners of the stationary knife. Above the stationary knife, is a pair of vacuum plates for holding the end of a supply web. Each of the knife members includes a body having a vertical leading surface facing in the direction of the running web. Each of the leading surfaces are provided with vacuum ports for holding the lower portion of a strip of tape thereto. A knife blade is mounted at the top of each of the knife members and a recess is provided between one end of the blade and the body to receive the upper portion of the tape strip to hold it out of contact with the running tape. A horizontally slideable nip bar arrangement is positioned below the knife members.

7 Claims, 3 Drawing Figures

BUTT SPLICER

This is a continuation of application Ser. No. 777,586, filed Mar. 15, 1977, now abandoned.

BACKGROUND OF THE INVENTION

The present invention relates to web splicers and, more particularly, to splicers for butt splicing the end of a spare roll of web to a web running from a depleting roll of web to provide a continuous supply of web to web-utilizing apparatus.

The prior art butt splicers generally have not been completely satisfactory for one or more reasons including excessive mechanical complexity, excessive cost of construction, need for duplicate parts to perform alternate splices, and failure to provide a strong splice. Some of the prior art butt splicer designs are disclosed in U.S. Pat. Nos. 2,987,108, 3,024,157, 3,645,463 and 3,939,032 and in Australian Pat. No. 166,368 (1955).

SUMMARY OF THE INVENTION

It is an object of the present invention to provide an improved butt splicer.

Another object is to provide a butt splicer of simple, reliable and low cost construction which performs efficiently and consistently produces a high quality strong splice. The foregoing objects are accomplished by providing a butt splicing apparatus for splicing the end of a supply web to a running web in which a pair of moveable knife members cooperate with a pair of spaced stationary knife blades to cut web. Means are provided for holding the end of the supply web at one of the knife edges while the running web is positioned between the other knife edge and the knife member cooperating therewith. In cutting a web, a knife member is moved toward the other knife member. The facing surfaces of the knife members have means for holding the lower portion of a strip of splicing tape, the knife member being formed to hold the upper portion of the tape out of contact with the running web during the cutting of the running web. The knife member cutting the running web is moved so that the facing surfaces act against each other to press the tape to the web.

BRIEF DESCRIPTION OF THE DRAWINGS

A preferred embodiment of the invention has been chosen for the purpose of illustration and description and is shown in the accompanying drawings forming a part of the specification wherein.

DESCRIPTION OF THE PREFERRED EMBODIMENT

Figure 1:
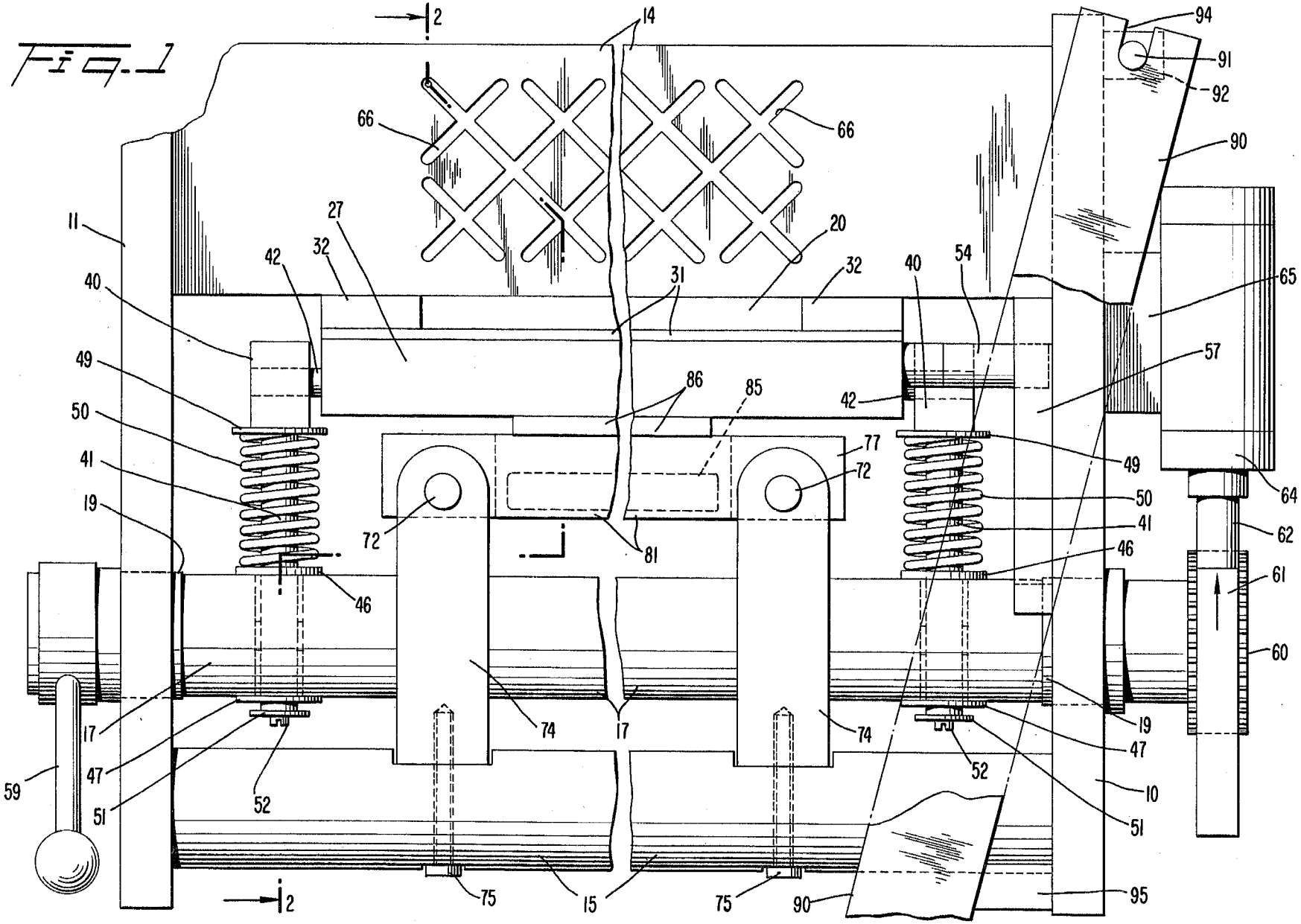
FIG. 1 is a side view of a butt splicer according to the present invention.

Referring to the drawings, the splicer according to the present invention includes a rear frame plate 10, a front plate 11, the frame plates being interconnected by a pair of vacuum plates 12, 14, and a pair of rods 15. A pair of shafts 16 and 17 extend through bearings 19 mounted in the plates 10 and 11. A stationary rectangular knife member 20 is mounted on the bottom of the vacuum plates 12, 14 and provides a pair of spaced knife edges 21 and 22. A pair of moveable knife members 24 and 25 are mounted on the rotatable shafts 16 and 17 respectively.

The moveable knife members 24 and 25 respectively include a body 26, 27. Each end of each body is pivotally mounted on a spring biased arm 29. A knife blade 30, 31 is mounted on the upper surface of the body 26, 27 respectively.

A horizontal knife guide plate 32 is mounted to each end of the stationary knife member 20 to properly position the knife blades 30 and 31 with respect to the knife edges 21 and 22.

The knife members 24 and 25 each have a surface 34 covered with a resilient pad 35. Vacuum is applied to the outer surface of the resilient pads 35 by means of a vacuum chamber 36 within the knife member and passageways 37 leading from the chamber 36 through the pads 35. The corner of the knife members 24, 25 where the knife blade approaches the surface 34 are formed to provide a recess 39 extending from the surface 34 along the inner surface of the knife blade 30, 31.

Vacuum is applied to the chamber 36 by means of a flexible hose attached to a convenient portion of the body 26, 27 and connected to the chamber by a suitable passageway.

Each of the arms 29 have a head 40 and a shaft 41. The heads 40 are connected to the ends of the knife members 24, 25 by means of pivot pins 42. The shafts 41 extend through a pair of bearing sleeves 44 and 45 which are positioned in opposite ends of bores extending transversely through the shafts 16 and 17. The bearing sleeves 44, 45 have flanges 46, 47 respectively on their outer ends. A washer 49 is positioned on the shaft 41 adjacent to the head 40 and the shaft extends through a coil spring 50 which acts against the washer 49 and the flange 46 of the bearing sleeve 44 to bias the head 40 away from the shaft 16, 17. A washer 51 is mounted to the end of the shaft 41 by means of a screw 52 to engage the flange 47 of the bearing sleeve 45 to retain the arm 29 within the bearing sleeves against the action of the spring.

When the shafts 15 and 16 are rotated to move the knife members 24, 25 toward the stationary knife 20, the springs 50 press the blades 31 tightly against the guides 32 and the blades 31 move horizontally along the guides.

In order to tilt the knife members 24, 25 to facilitate setting up the apparatus for a splice, a cam follower 54 is mounted on one end of each of the members 24, 25. When the shafts 16 and 17 are rotated to move the knife members 24, 25 away from the knife 20, the cam followers 54 engage curved cam slots 55 formed in a cam plates 56, 57 mounted on the frame plate 10 on either side of the stationary knife 20. When the cutting edge of the knife blade 31 reaches the end of the guide 32, the spring 50 has moved the arm 29 upwardly and outwardly until the washer 51 is seated on the flange 47.

Figure 2:
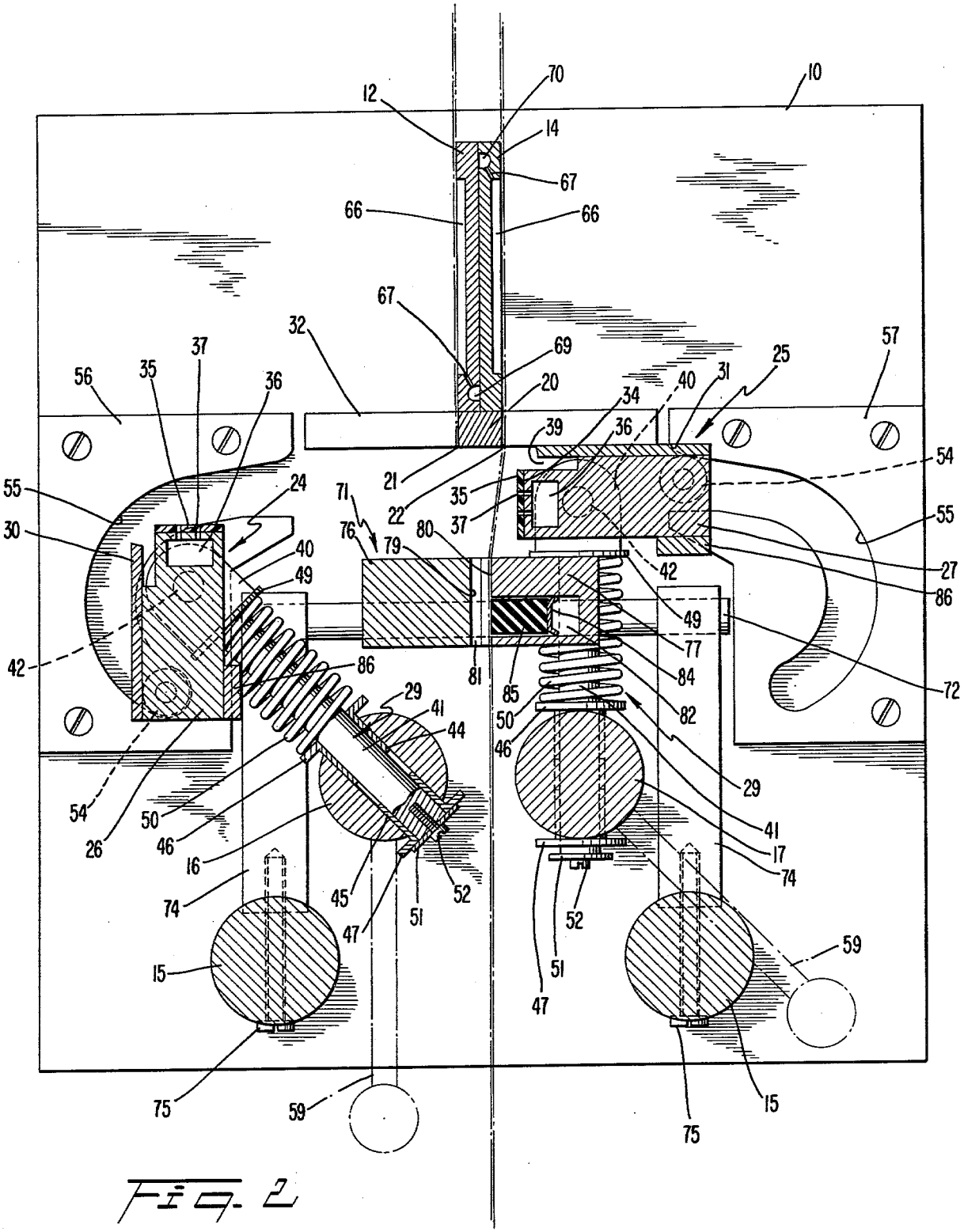
FIG. 2 is a cross sectional view taken along the line 2—2 of FIG. 1.

As shown in FIG. 1, and in phantom in FIG. 2, the shafts 16 and 17 are provided with handles 59 on the ends thereof extending through the frame plate 11. The other end of each of the shafts 16 and 17 extend through the plate 10 and, as shown in FIG. 1, gears 60 are mounted thereon. Each of the gears 60 are meshed with the teeth of a rack gear 61 formed on the piston shaft 62 of an air actuator 64, only one of which is shown. The air actuators 64 are mounted to the rear face of the plate 10 by means of mounting blocks 65.

The vacuum plates 12 and 14 are provided with a plurality of intersecting grooves 66 in the outer surfaces thereof which are connected through ports 67 to passageways 69, 70 that run axially along the inner surface of the plates 12, 14 and are connected to separate vacuum supply hoses (not shown).

A nip bar assembly 71 is mounted on a pair of horizontal shafts 72 below the knife bar 20. Each of the shafts 72 are mounted on a pair of posts 74 which extend vertically from each of the rods 15. The posts 74 are set in recesses in the rods 15 and bolts 75 extend upwardly through the rods into the posts.

The nip bar assembly 71 includes a pair of blocks 76 and 77 each of which is formed with a recessed surface 79, 80. The blocks are positioned with the surfaces 79 and 80 facing each other to form a wide rectangular passageway 81 through which the running web passes.

The block 77 is formed with a cavity 82 extending from the surface 80. A piston member 84 and a firm rubber bar 85 are positioned in the cavity. Air under pressure is introduced into the cavity 82 when it is desired to clamp the running web. The pressure in the cavity acts on the piston member 84 to extend the bar 85 to engage and clamp the web.

The nip bar assembly 71 is positioned along the shafts 72 by a striking plate 86 mounted on the lower surface of each of the body members 26, 27 of the moveable knife members 24, 25.

As shown in FIG. 1, the splicing unit just described is mounted on a support having two arms 90. A pivot pin 91 extends from a block 92 which is mounted to each edge of the frame plate 10. The pivot pins 91 are seated in notches 94 formed in the end of the arms 90. The arms 90 are held in a vertical position by frame members not shown and the splicing unit is held in a position displaced from the vertical by a bar 95 which is interposed between the arms and the bottom edge of the frame plate 10. The splicing unit is positioned at an angle to the vertical so that the web is cut and spliced along a line which angles across the web and thereby provides a longer and stronger splice line.

Figure 3:
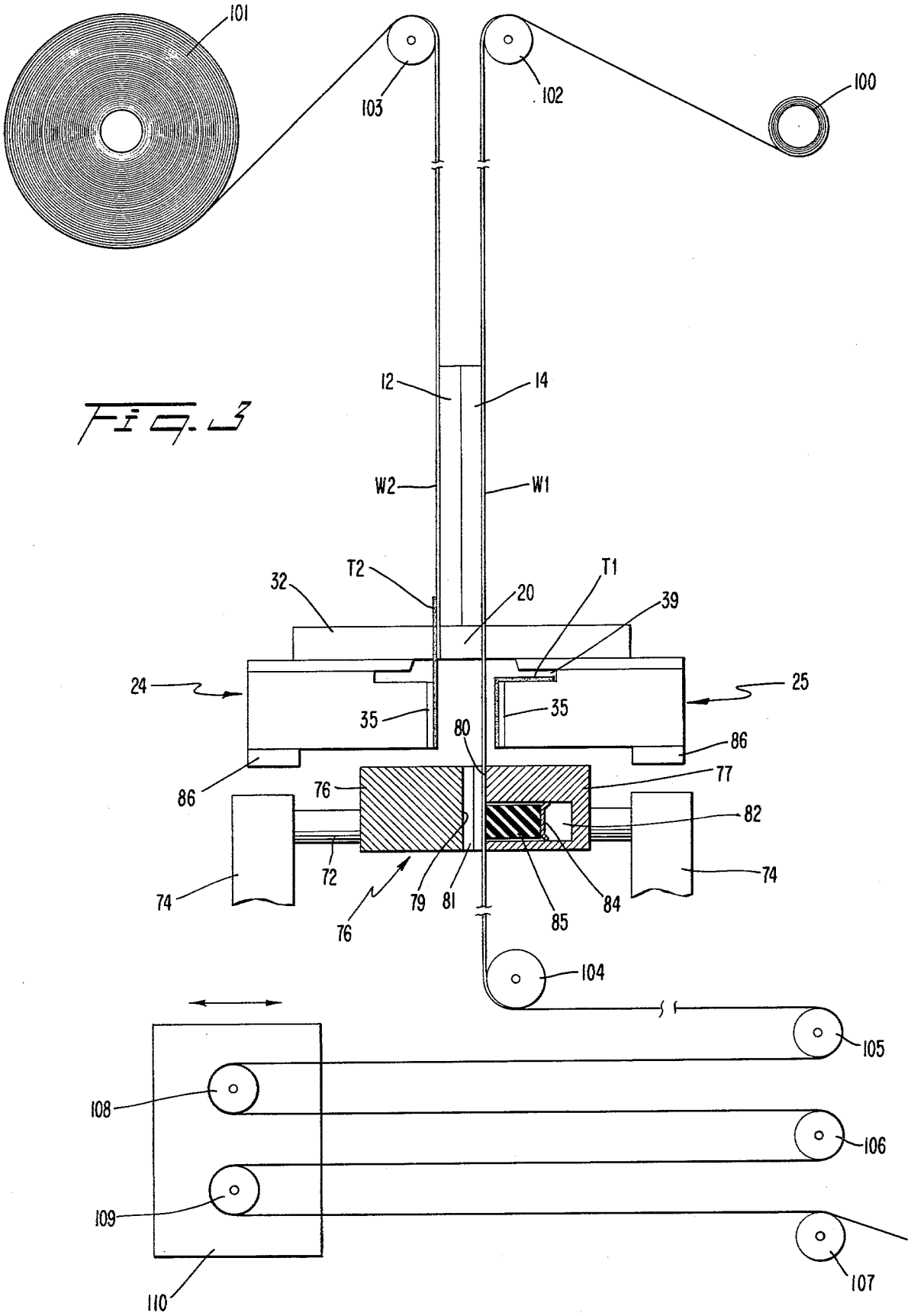
FIG. 3 is a schematic view of the major elements of the splicing head showing the head in condition to produce a splice.

Referring now to FIG. 3, there is shown in schematic form a splicing unit according to the present invention positioned within a web supply system which includes a depleting roll of web 100, a full roll of web 101 about to be spliced onto the depleting web, a pair of rollers 102 and 103 for directing the web from the two rolls to the splicing unit, and a festoon including four stationary rollers 104–107 and two rollers 108 & 109 mounted on a festoon carriage 110.

The running web W1 extends from the roll 100 around the roller 102, down along the face of the vacuum plate 14, through the passageway 81 in the nip bar assembly 71, and, in turn, around the rollers 104, 105, 108, 106, 109 and 107 to the utilizing apparatus.

The festoon carriage is mounted for horizontal movement on rods or the like (not shown) and is biased away from the stationary rollers by a device such as a constant pressure air cylinder. During the splicing operation, motion of the web through the splicing head is stopped by the nip bar assembly. The pull on the web exerted by the web-utilizing apparaus then draws the festoon carriage toward the stationary rollers. In this manner, the web stored in the festoon is supplied to the utilizing apparatus during the splicing operation. A constant tension on the web leaving the festoon is commonly maintained by an interconnection between a brake on the supply roll spindle and a lever actuated by motion of the carriage.

To prepare the unit for a splice, the vacuum plate 12 is actuated and the web W2 from the supply roll 101 is passed over roller 103 and is laid against the vacuum plate 12 so that the end protrudes below the knife 20. The left knife 24 is then moved inwardly manually (by the handle 50) to trim the end of the supply web W2.

A strip of adhesive tape T1 is placed on the moveable knife 25 with its lower section held to the pad 35 by vacuum and its upper section positioned in the recess 39. The tape T1 has adhesive only on one side and the tape is positioned with the non-adhesive side in contact with the pad 35. A second piece of tape T2 is positioned on the moveable knife 24 with the lower portion of its non-adhesive side held to the pad 35 by vacuum. The moveable knives 24, 25 are tilted by the cam mechanism as previously described to affix the tapes thereto. The knives are then returned to the position shown in FIG. 3 and the upper portion of the tape T2 is pressed against the end of web W2. The unit in this condition is ready to perform a splicing operation.

When the splice is initiated, either by manual control or by an automatic device which senses the depletion of the web on the roll 100, pressurized air is introduced into the chamber 82 in the nip bar 77 to extend the bar 85 and clamp the running web. The air actuator 64 controlling the knife member 25 is then actuated driving the knife member 25 toward the knife member 24. The web W1 is displaced to the left by contact with the lower portion of tape T1, the blade 31 cuts the web, and the knife member 25 impacts against the knife member 24 pressing the bottom portions of the tapes T1 and T2 firmly to the lower cut end of the web. The tape T2 now connects the web W2 to the lower cut end of the web W1 providing a splice on one side of the tape. As the knife member 25 cuts the web W1, the bar 86 strikes the nip bar assembly 71 and carries it toward the left to align the passageway 81 with the web W2.

The pressure in the cavity 82 is then vented to unclamp the web and the spliced section moves downwardly pulling the upper portion of the tape T1 from the recess 39. As the splice moves past the roller 104, the upper portion of the tape T1 is pressed against the spliced end of the web W2 to complete a double face splice.

The depleted roll 100 is now replaced by a full supply roll and the unit can be prepared for the next splice by the procedure described above, except of course, the function of the similar parts are reversed, as if in a mirror image.

It will be seen from the foregoing that the present invention provides an improved butt splicer of simple, reliable and low cost construction which performs efficiently and consistently produces a high quality stong splice.

We claim:

1. Apparatus for butt splicing the end of a supply web to a running web including stationary knife means having a pair of spaced knife edges; first and second moveable knife members each selectively cooperating with a respective one of said knife edges to sever said running web; means on said stationary knife means for holding the end of said supply web at either of said knife edges, the running web being positioned on the opposite side of said stationary knife means from the supply web and between the knife edge and the moveable knife member cooperating therewith; each of said knife members including a leading surface, means on each said surface for holding the lower portion of a strip of adhesive tape, and means providing a recess adjacent each said leading surface for receiving the upper portion of a strip of tape carried by the moveable knife which is adjacent the running web; means for moving the moveable knife member adjacent the supply web into a ready position where the leading surface thereof is aligned with the end of the supply web and holds the end of a strip of tape which is affixed to the end of the supply web, and means for moving said knife member adjacent to the running web toward the other knife member so that the running web is cut and the leading surfaces act against each other to press the two tape strips to opposite sides of the web ends, each said recess being formed to keep the upper portion of the tape strip out of contact with the web ends during the splicing operation until it is drawn from the recess by movement of the spliced web.

2. Apparatus according to claim 1 including a web braking assembly comprising unitary block means having a passageway therein through which the running web passes after passing the knife members, and piston means for clamping the web in said passageway during a splice operation.

3. Apparatus according to claim 2 wherein said block means is mounted for movement transversely with respect to the running web and said moveable knife members include means for engaging and repositioning said block means when a splice is made to align said passageway with the line of travel of the web spliced on.

4. Apparatus according to claim 3 wherein said moveble knife members each include a body having a vacuum chamber therein and vacuum ports in said leading surface for holding tape strips.

5. Apparatus according to claim 4 wherein said moveable knife members each include a knife blade mounted on said body, and wherein said recess is provided between said blade and said body extending from said leading surface to retain the upper portion of the tape strip.

6. Apparatus according to claim 5 including knife blade guide bars aligned with said stationary knife means and means for pressing said knife members against said guide bars.

7. Apparatus according to claim 6 wherein said moveable knife members are mounted on rotating shafts.

* * * * *